US005840003A

United States Patent [19]

Meetze, Jr. et al.

[11] Patent Number: 5,840,003

[45] Date of Patent: Nov. 24, 1998

[54] STALLED SHEET FOLDING AND FLATTENING APPARATUS IN AN ELECTROSTATOGRAPHIC MACHINE

[75] Inventors: Murray O. Meetze, Jr., Rochester; Kenneth G. Christy, Webster; Arthur H. Kahn, Cohocton; Thomas P. Lambert, Webster, all of N.Y.

[73] Assignee: Xerox Corporation, Stamford, Conn.

[21] Appl. No.: 837,027

[22] Filed: Apr. 11, 1997

[51] Int. Cl.[6] ..... B31B 1/26; B30B 3/02

[52] U.S. Cl. ..... 493/405; 493/407; 493/417; 493/446

[58] Field of Search ..... 493/395, 405, 493/407, 419, 446, 447, 455, 464, 477, 478, 479, 480; 399/21, 124

[56] References Cited

U.S. PATENT DOCUMENTS

| | | | |
|---|---|---|---|
| 4,990,966 | 2/1991 | Sindo | 399/124 |
| 5,255,061 | 10/1993 | Matsuura et al. | 399/124 |
| 5,652,942 | 7/1997 | Iseki et al. | 399/21 |

OTHER PUBLICATIONS

Kurtz, Robert L. et al., "Paper Eject Baffle", *Xerox Disclosure Journal,* vol. 8, No. 4, Jul./Aug. 1983, pp. 297–298.

*Primary Examiner*—John Sipos
*Assistant Examiner*—Christopher W. Day
*Attorney, Agent, or Firm*—Tallam I. Ngupi

[57] ABSTRACT

A stalled sheet folding and flattening apparatus for reducing a sheet, stalled between a withdrawable and a fixed component of a cut sheet handling system of a sheet handling machine, into a shape and size suitably enabling reliable removal of the stalled sheet through even a relatively narrow gap between the withdrawable and fixed components of the sheet handling system. The stalled sheet folding and flattening apparatus includes a fixed component of the sheet handling system connected to a frame of the machine and having a first section of a sheet path; a withdrawable component of the sheet handling system mounted to the frame, and having a sheet flattening side defining a relatively narrow gap between a fixed surface within the machine and the withdrawable component, and including a second section of the sheet path adjoining the first section of the sheet path; and a sheet folding device mounted to the fixed component. The sheet folding device includes a generally U-shaped portion defining a slot and having a sheet contact surface forming a part, of an edge of the first section of the sheet path, for contacting and deflecting into a first fold, an edge of a sheet stalled across an interface between the first and the second sections of the sheet path, when the withdrawable component is being pulled out of the machine. The sheet contact surface of the U-shaped portion has a first radius of curvature defining a first concave surface for deflecting and folding the stalled sheet, and a second radius of curvature defining a second surface for guiding the folded sheet out of the slot.

9 Claims, 4 Drawing Sheets

STALLED SHEET FOLDING AND FLATTENING APPARATUS IN AN ELECTROSTATOGRAPHIC MACHINE

RELATED CASE

This application is related to U.S. application Ser. No. 08/837,027 (now U.S. Pat. No. 5,732,620 issued Mar. 31, 1998) (Applicants' Docket NO. D/96775Q) entitled "STALLED SHEET PULLING AND CRUSHING APPARATUS IN AN ELECTROSTATOGRAPHIC MACHINE" filed on even date herewith, and having common inventors.

BACKGROUND

This invention relates generally to electrostatographic reproduction machines using copy sheets, and more particularly, to apparatus for folding and flattening a stalled sheet so as to enable its effective removal from a relatively narrow gap between machine components.

In a typical electrostatographic reproduction process machine, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This process records an electrostatic latent image on the photoconductive member corresponding to the informational areas contained within the original document.

After the electrostatic latent image is recorded on the photoconductive member, the latent image is developed by bringing a developer material into contact therewith. Generally, the developer material is made from toner particles adhering triboelectrically to carrier granules. The toner particles are attracted from the carrier granules to the latent image forming a toner powder image on the photoconductive or image bearing member. The toner powder image is then transferred at an image transfer station, from the photoconductive member, to a copy substrate such as a copy sheet of paper. Thereafter, heat or some other treatment is applied to the toner particles at a fusing station to permanently fuse and affix the toner powder image to the copy sheet or substrate.

The copy sheet or substrate typically is fed automatically from a stack supply thereof, along a sheet transport path that includes a sheet registration subassembly, to the image transfer station where the toner image is transferred from the image bearing member onto a first side of the copy sheet. As discussed above, after such toner image transfer, the copy sheet is moved along the sheet path to the fusing station of the machine where the toner image is fused and affixed to the copy sheet. In machines with duplex copying capability, the sheet path usually includes a sheet inverter, and the copy sheet after leaving the fusing station, is inverted at the inverter and refed to the transfer station in proper orientation for receiving a second toner image on a second side of the copy sheet. In either case, the copy sheet with the fused toner image or images on it is then forwarded to an output tray or finishing station.

High quality output copies typically require proper and high quality registration of the toner image or images on the copy sheet. To achieve such registration, the copy sheet must be transported in a timed and registered manner to the sheet registration subassembly and to the transfer station each time, and sheet drive mechanisms along the sheet path have to function without slippage. Presence and proximity sensors can be used for assisting the achievement of such proper and timed registration of each copy sheet.

Typically, any failure of a copy sheet being transported along the sheet path to activate any of the above sensors at a control point, in time or space, usually registers as a machine error. Detection of such an error usually results a copy sheet stall or jam along the sheet path, as well as in a machine shutdown, and in a call or alert for an operator to remove or clear the stalled or jammed copy sheet, wherever it may be, along the sheet transport path.

"Works in a drawer" sheet handling subsystems in sheet handling machines are often favored because of the benefits they offer for clearing jammed or stalled sheets contained entirely within the subsystem. Such drawer designs are particularly employed for electrostatographic machine subsystems such as fuser and post-fuser sheet inverter subsystems that ordinarily include hidden sheet paths that are hard or unsafe to access. Typically, the withdrawable drawer or module design of such a subsystem is supported on a portion of the frame of the machine, and is made movable in and out of the machine, relative to other fixed portions or components of the machine. As higher and higher speed machines are made to have a smaller and smaller footprint, the gap or interface between withdrawable subsystems and fixed components are becoming narrower and narrower.

Unfortunately, sheets moving through and across such an interface between a withdrawable module and a fixed portion or component of the machine, can become jammed or stalled across such interface. Where as disclosed, for example in Xerox Disclosure Journal, Vol. 8, No. 4, July/August 1983, there is sufficient open space within the machine above or below the withdrawable component or module, a simple contoured ramp can be used to deflect a loose end of the stalled sheet into such open space. Such a simple ramp however will not work where there is only a narrow gap and no such open space. It also will not work in a case where the stalled sheet is within the grip of a nip at both the withdrawable module side.

Clearing a stalled or jammed sheet in each of these cases presents very unique problems, which often can include preventing the withdrawable module from being movable in or out of the machine. Ordinarily, when the withdrawable module is prevented from being movable in or out of the machine as such, any further attempts to forcibly free it, usually will result in tearing of a portion of the sheet, or in a more severe jam requiring a complete machine shutdown as well as an expensive technical service call. Therefore to avoid such complete shutdowns, and to keep the machine functioning properly, a sheet stalled or jammed in such an interface must be withdrawn in a manner so as not to tear the sheet and not to leave torn bits and pieces of the sheet in the hidden and inaccessible sheet path.

There is therefore a need to provide apparatus for reducing a sheet, stalled between a withdrawable and a fixed module of an electrostatographic machine, into a shape and size that enable the stalled sheet to be reliably removed through even a relatively narrow gap between the withdrawable and fixed components of the machine.

SUMMARY OF THE INVENTION

In accordance with the present invention, there is provided a stalled sheet folding and flattening apparatus for reducing a sheet, stalled between a withdrawable and a fixed component of a cut sheet handling system of a sheet handling machine, into a shape and size suitably enabling reliable removal of the stalled sheet through a relatively narrow gap between the withdrawable and fixed components of the sheet handling system. The stalled sheet folding and flattening apparatus includes a fixed component of the sheet handling system connected to a frame of the machine and having a first section of a sheet path; a withdrawable component of the sheet handling system mounted to the frame, and having a sheet flattening side defining a relatively narrow gap between a fixed surface within the machine and the withdrawable component, and including a second section of the sheet path adjoining the first section of the sheet path; and a sheet folding device mounted to the fixed component. The sheet folding device includes a generally U-shaped portion defining a slot and having a sheet contact surface forming a part, of an edge of the first section of the sheet path, for contacting and deflecting into a first fold, an edge of a sheet stalled across an interface between the first and the second sections of the sheet path, when the withdrawable component is being pulled out of the machine. The sheet contact surface of the U-shaped portion has a first radius of curvature defining a first concave surface for deflecting and folding the stalled sheet, and a second radius of curvature defining a second surface for guiding the folded sheet out of the slot.

BRIEF DESCRIPTION OF THE DRAWINGS

Other features of the present invention will become apparent as the following description proceeds and upon reference to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 4:
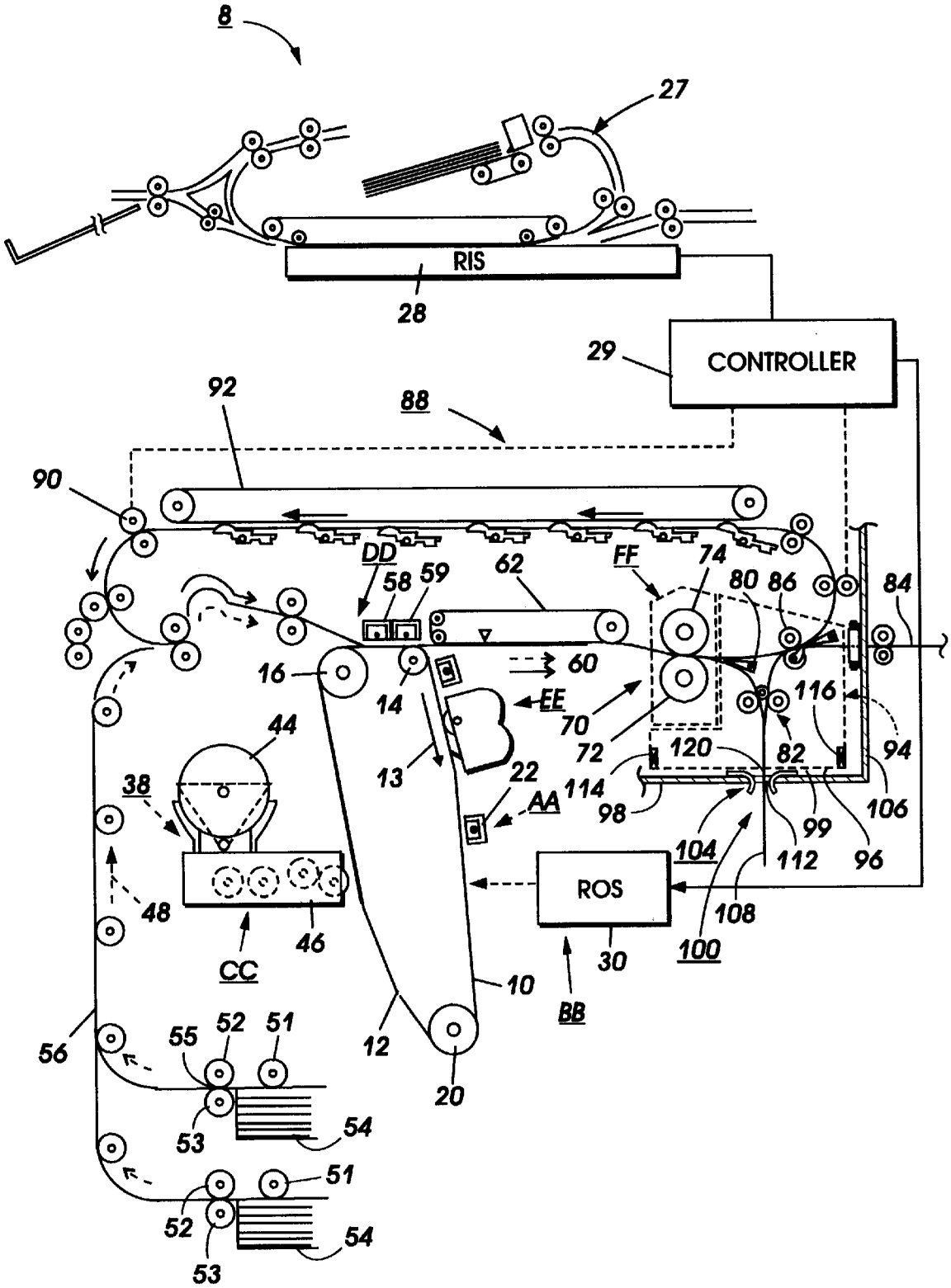
FIG. 4 is a schematic elevational view of a typical electrostatographic reproduction machine including the stalled sheet folding and flattening apparatus of the present invention.

Referring now to FIG. 4 of the drawings, an electrostatographic reproduction machine 8 is illustrated in which an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS).

As shown, the electrostatographic reproduction machine 8 generally employs a photoconductive belt 10 that is preferably made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 16 and drive roller 20. As roller 20 rotates, it advances belt 10 in the direction of arrow 13.

Initially, a portion of the photoconductive surface passes through charging station AA. At charging station AA, a corona generating device indicated generally by the reference numeral 22 charges the photoconductive belt 10 to a relatively high, substantially uniform potential.

At an exposure station BB, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrostatographic reproduction machine 8 to serve as a remotely located printer for one or more computers. Alternatively, the printer may serve as a dedicated printer for a high-speed computer.

The signals from ESS 29, corresponding to the continuous tone image desired to be reproduced by the reproduction machine 8, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station CC, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 39, dispenses toner particles into developer housing 40 of developer unit 38.

With continued reference to FIG. 4, after the electrostatic latent image is developed, the toner powder image present on belt 10 advances to transfer station DD. A print sheet 48 is advanced to the transfer station DD by a sheet feeding apparatus, 50. Preferably, sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56. Vertical transport 56 directs the advancing sheet 48 of support material into the registration transport 120 of the invention herein, described in detail below, past image transfer station DD to receive an image from photoreceptor belt 10 in a timed sequence so that the toner powder image formed thereon contacts the advancing sheet 48 at transfer station DD. Transfer station DD includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62 which advances sheet 48 to fusing station FF.

As shown, at fusing station FF, a fuser assembly 70 and a single sheet inverter mechanism 82 (to be described in detail below) are mounted removably as a withdrawable module 94 on a common platform 96. Fusing station FF as shown includes the fuser assembly indicated generally by the reference numeral 70 which permanently fuses and affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

In a flawless operation with no sheet jams, the sheet passes through fuser or fuser assembly 70 where the image is permanently fixed or fused to the sheet. After passing through fuser 70, a gate 80 either allows the sheet to move directly through an output nip 86 and via an output path 84 to a finisher or stacker (not shown), or it deflects the sheet into the single sheet inverter 82, from which it then enters a duplex path 88. Specifically, if the sheet is either a simplex sheet, or a two-pass duplex sheet on its second pass from the fuser, such sheet will be conveyed via gate 80 directly to output path 84. However, if the sheet is being duplexed and it is on its first pass from the fuser on its way back for its second pass, then the gate 80 will be positioned so as to deflect that sheet into the inverter 82. From the inverter 82, it is then fed into the duplex path 88, where it is fed to acceleration nip 90 and belt transports 92. There it is recirculated back through transfer station DD and fuser 70 for receiving and permanently fixing the side two image to the backside of that duplex sheet, before it exits via exit path 84.

However, as is well known, in any electrostatographic reproduction machine 8 or sheet handling machine 8 including cut sheet handling components or modules, sheets can, and do stall. In some such machine 8*s*, for example the machine 8 (FIG. 4), withdrawable components such as 94 are mounted adjacent fixed components 98 leaving only a very narrow gap 99 of about 8 mm or less between them, and through which a sheet being moved from one to the other of the two types of components must be removed if it stalls.

For example, in the machine 8 of FIG. 4, sheet jams or sheet stalls do occur with sheets being moved through the fuser assembly 70 to the output path 84, as well as with sheets being moved from the fuser assembly 70 through the inverter 82 and into the duplex path 88. A copy sheet stall or jam during either of these two movements ordinarily will result in a temporary and partial machine 8 shutdown, and in a call or alert for an operator to remove or clear the stalled or jammed copy sheet, wherever it may be. However, as pointed out above, because of the hidden nature of the sheet path, and the narrowness of the gap 99 through which the stalled sheet must be removed, ordinary attempts to remove stalled sheets frequently result in aggravated jams that end up locking or binding the fuser assembly 70 in place, thus creating a complete machine 8 shutdown and a major technical service call. In accordance to the present invention however, such aggravated jams are prevented by use of the stalled sheet folding and flattening apparatus 100 of the present invention (to be described in detail below).

Still referring to FIG. 4, after the print sheet is separated from photoconductive surface 12 of belt 10, the residual toner/developer and paper fiber particles adhering to photoconductive surface 12 are removed therefrom at cleaning station EE. As shown, cleaning station EE may include a rotatably mounted fibrous brush in contact with photoconductive surface 12 to disturb and remove paper fibers, and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

As further shown (FIG. 4) the various components and functions of the machine 8 are regulated by a controller 29. The controller is preferably a programmable microprocessor which can be programmed to provide various controls including for example a comparison count of the copy sheets, the number of documents being recirculated, the number of copy sheets selected by the operator, time delays, jam corrections, etc.. The control of all of the exemplary systems heretofore described may be accomplished by conventional control switch inputs from the reproduction machine 8 consoles selected by the operator. Conventional sheet path sensors or switches may be utilized to keep track of the position of the document and the copy sheets.

Referring now to FIGS. 1 to 4, the sheet handling machine 8 has a frame 106 (shown only partially), and a cut sheet handling system comprised for example of subsystems 70, 82, 92 including a sheet path comprised for example of segments 84, 88. Importantly, the machine 8 includes the stalled sheet folding and flattening apparatus 100 in accordance with the present invention, for reducing a sheet 108 stalled between the withdrawable and the fixed components 94, 98 respectively, into a shape and size 110 (FIG. 3) that suitably enables reliable removal of the stalled sheet 108 through even the relatively narrow gap 99 between the withdrawable and fixed components 94, 98.

As shown, the fixed component 98 is preferably a portion of the frame 106 of the machine 8, or it could be any other component of the sheet handling system that is mounted fixedly to the frame 106. In either case, the fixed frame portion or component 98 includes a first section 112 of the sheet path at the interface between the withdrawable and the fixed components. The stalled sheet folding and flattening apparatus 100 also includes a withdrawable component such as the component or module 94, which as shown, is mounted movably on rails 114, 116, to the frame 106. The withdrawable component 94 importantly includes a sheet flattening side 118 (FIG. 3) which has a second section 120 of the sheet path located such that the second section 120 adjoins the first section 112 thereof when the component 94 is pushed back into place within the machine. The sheet flattening side 118 defines the relatively narrow gap 99 between a fixed surface 122 within the machine 8, and the withdrawable component 94.

Figure 1:
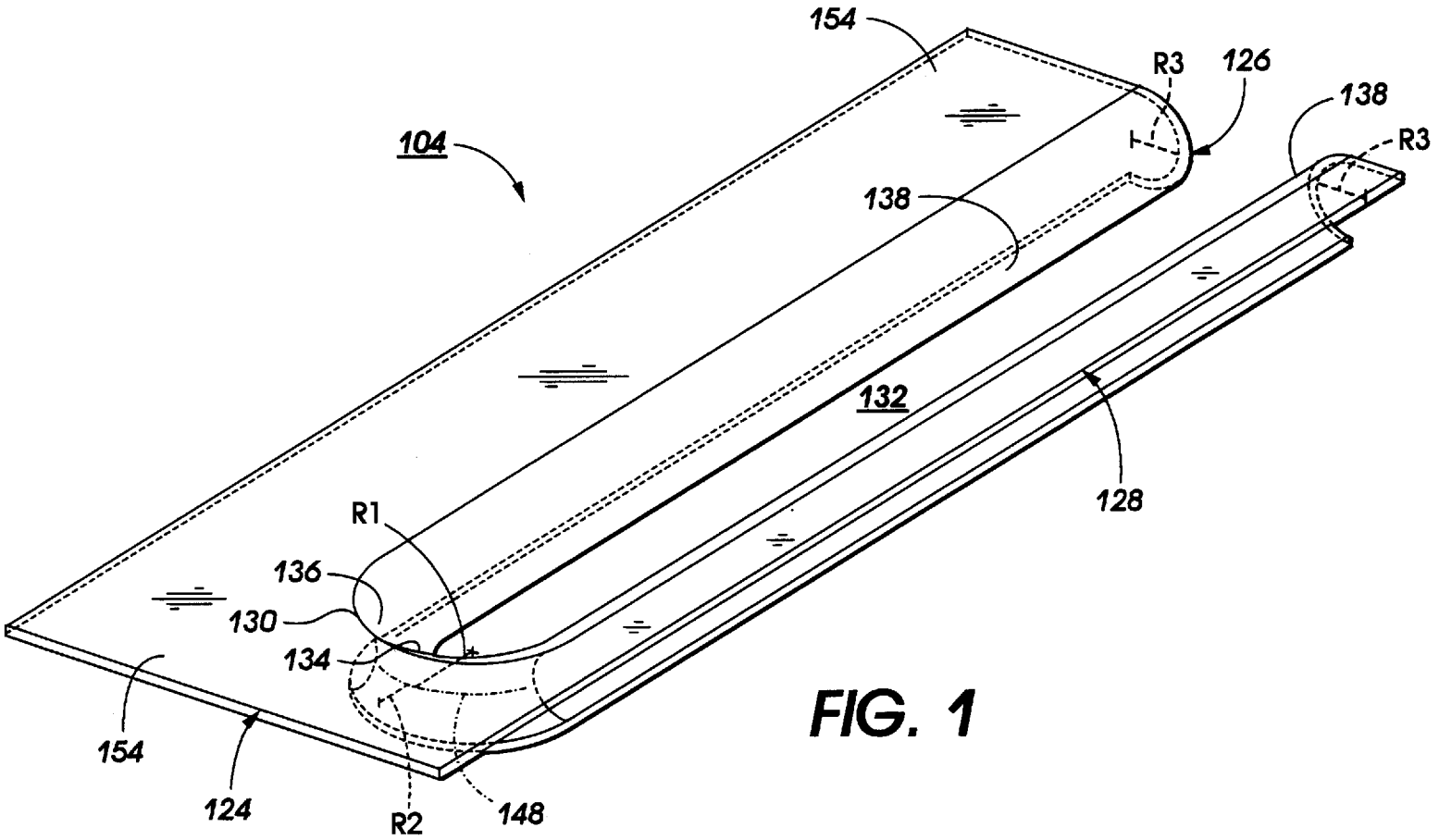
FIG. 1 is a perspective illustration of the stalled sheet folding device of the present invention.

Turning next to FIG. 1 in particular, the stalled sheet folding and flattening apparatus 100 as shown, importantly includes a sheet folding device 104 which as illustrated is suitable for mounting to the fixed component or frame portion 98 for deflecting, folding and guiding a stalled sheet being pulled out with the withdrawable component 94, through the narrow gap 99. As further illustrated, the sheet folding device 104 comprises a generally U-shaped member 124 that includes first and second arm portions 126, 128 respectively, and a base portion 130, that together define a sheet guiding and folding slot 132. When mounted within the machine, the slot 132 forms part of the sheet path at the interface between the withdrawable and fixed components of the machine. The base portion 130 advantageously has a sheet contact compound surface including a concave inside surface 134 forming, within the fixed component 98, a part of an edge of the first section 112 of the sheet path therethrough.

Figure 2:
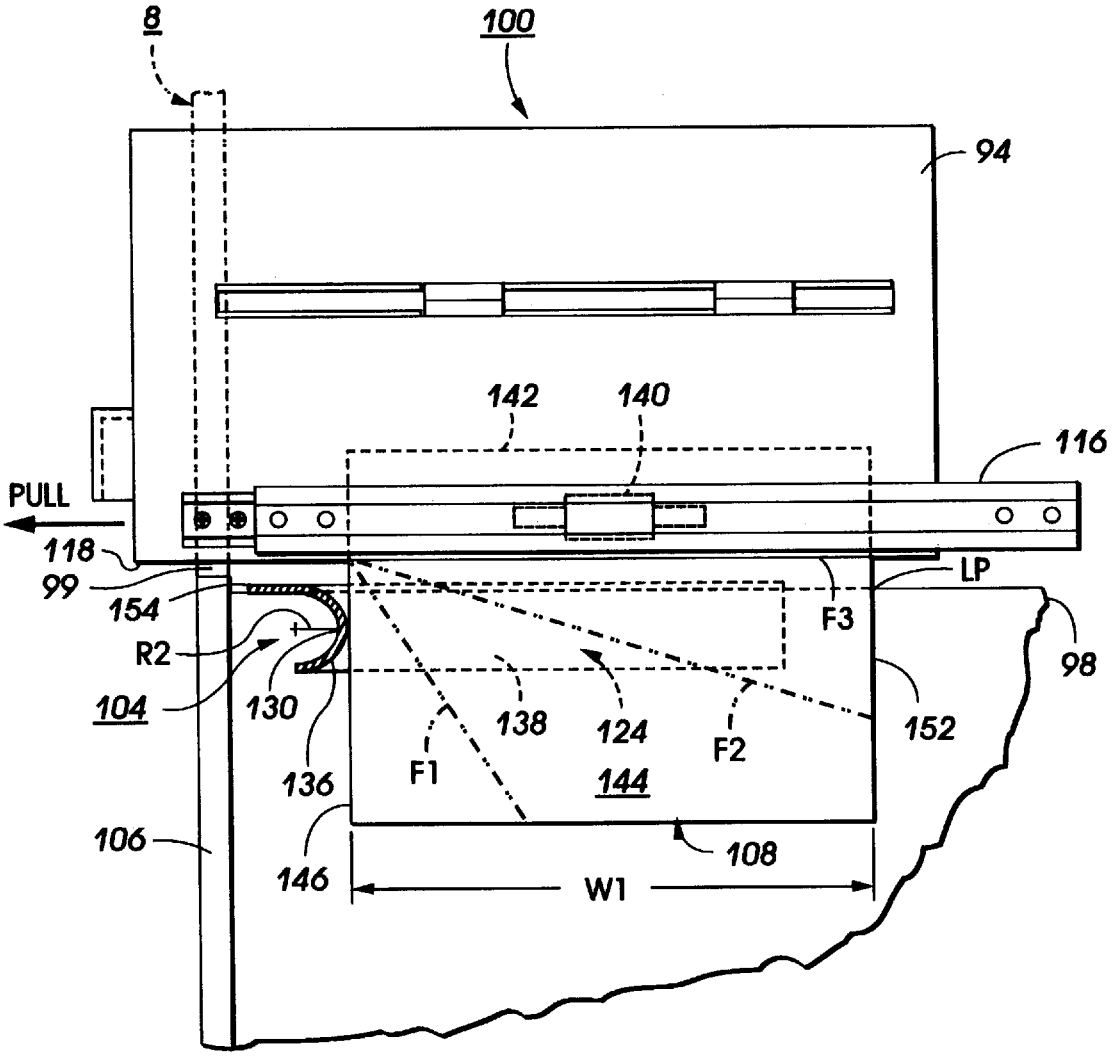
FIG. 2 is an illustration of the stalled sheet folding and flattening apparatus of the present invention including the sheet folding device of FIG. 1.

The sheet contact compound surface of the U-shaped portion 124 importantly includes a first radius R1 of curvature for defining the concave inside surface 134, and a second radius R2 of curvature for defining a second, and convex surface 136 (see FIG. 2). The concave surface 134 is useful for contacting and deflecting, towards either side of a sheet, an edge of a portion of a stalled sheet 108 that extends across the interface between the withdrawable and the fixed components 94, 98 respectively, when the withdrawable component 94 is being pulled out of the machine 8. As further illustrated, the first and second arm portions 126,128 each includes a radius R3 of curvature defining another convex surface 138 that each adjoins the surface 136, and together comprise the sides of the slot 132, and part of the first section 112 of the sheet path, for guiding the stalled sheet 108. As shown, the second section 120 of the sheet path as shown (FIGS. 2 and 4) includes a sheet gripping nip 140 for retaining a trail end 142 of a stalled sheet 108 that is being pulled out of the machine 8 by the withdrawable component 94.

In operation, when a sheet 108 stalls across the interface between withdrawable and fixed components 94, 98 respectively, the trail end 142 of the stalled sheet is retained within the nip 140. A portion 144 of the sheet 108 extends across the interface and hangs loosely through the second section 120 (which in this case is merely a slot or opening through the frame of the machine) of the sheet path as illustrated. As the withdrawable component is being pulled out of the machine on the rails 116,118, a side edge 146 of the sheet that faces the base portion 130 of device 124, is brought into contact with a common surface line 148 on the concave 134, and convex 136 surfaces of the base portion 130. The surface line 148 contacts and deflects the edge 146 to one side or the other of the sheet 108 within the slot 132, thus creating a first fold line F1 in the extending portion 144 of the sheet 108.

Figure 3:
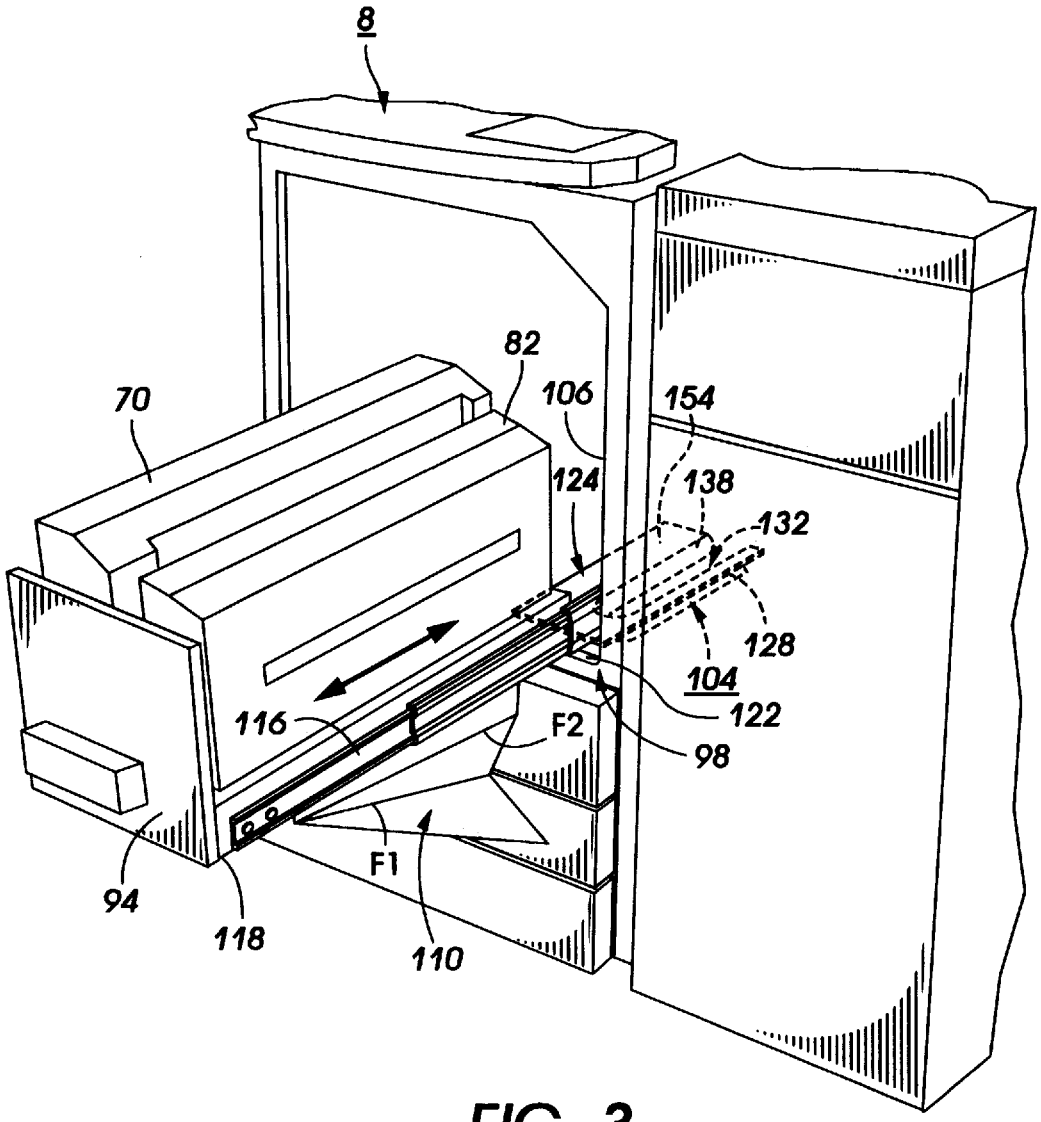
FIG. 3 is a further illustration of the stalled sheet folding and flattening apparatus of the present invention of FIG. 2 showing the withdrawable sheet handling component thereof in a pulled-out or withdrawn position.

The concave surface 134, and convex surface 136 of the base portion, as well as the convex surface 138 of each arm portion 126, 128 then cooperate with the sheet flattening side 118 of the withdrawable component 94 (as 94 is being pulled out of the machine), to buckle and further fold the extending portion 144 along fold lines F2, and F3 (FIGS. 2 and 3). The portion 144 thus is buckled and folded as it is being pulled reliably without a risk of tearing, over the convex surface 136, and into the narrow gap 99 beneath the sheet flattening side or surface 118. Within the gap 99, it is flattened into the shape and size 110, thereby enabling the sheet 108 to be reliably withdrawn with the withdrawable component 94, during a jam clearance, through the very narrow gap 99 (FIG. 3). The sheet 108 as pulled out (FIG. 3) without a tear therein, is then accessible to an operator who can thereafter grasp it, release it and pull it out of the nip 140.

Further in accordance with the present invention, in order to cause the side edge 146 of the extending sheet portion 144 to fold at F1, and the remainder thereof to buckle into at least a second fold F2, it is preferable that the first radius R1 of the concave surface be less than one half of an edge to edge dimension W1 of the stalled sheet 108. As illustrated, the sheet 108 of course is being moved, lead end, followed by trail end 142, through the sheet path. In particular, in order to cause the side edge 146 of the extending sheet portion 144 to fold at F1, and the remainder thereof to buckle into two additional fold lines folds F2, F3, it is preferable that the first radius R1 of the concave surface be less than one third the edge to edge dimension W1.

Although the base portion 130 is shown as having a hollow exterior surface, it is understood that the exterior surface thereof can equally be solid, thereby making the base portion 130 resemble a half donut shape that is useful as a convex folding ramp or surface 136 which is part of the slot 132 for sheets moved below the inverter 82. The edges 138, 148 of the slot 132 work with the convex donut section surface 136 to fold the portion 144 of the sheet as above. As the component 94 starts to move out under an operator pull, the side edge 146 engages the surfaces 134,136 and is deflected to one side or the other above a point shown by a line LP, thus forming the first fold F1. This creates a buckle and a beginning for a second fold F2. Before the first fold line F1 actually forms, this first buckle and second fold line F2 form first. This is due in part to the fact that the portion 144 and its rear or opposite side edge 152 are being lifted out of the slot 132 over the convex surface 136 as the component 94 continues to be moved out of the machine. Lifting the portion 144 as such causes sheet material between fold lines F2 and F1 to be forced against the convex surface 136 of the slot 132, resulting in a second buckle that forms in the sheet material between fold lines F2 and F3. This second buckle thus begins from the fold line F2 in a zag and opposite direction to a zig direction of sheet movement that resulted in the first fold line F1.

As further illustrated, the convex surface 136 adjoins a flat lip 154 of the sheet folding device 104 that preferably is in the same surface as the fixed surface 122 for cooperating with the side or surface 118 on the withdrawable component 94 to flatten the deflected, buckled and folded sheet portion 144 into the shape and size 110 (FIG. 3).

It is, therefore, apparent that there has been provided in accordance with the present invention, a stalled sheet folding and flattening apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

While the invention herein has been described in the context of an electrostatographic cut sheet using machine, it will be readily apparent that the stalled sheet folding and flattening apparatus thereof can be utilized in any cut sheet handling machine that has a sheet handling system including withdrawable components and fixed components forming interfaces across which sheets can stall.

What is claimed is:

1. In a sheet handling machine having a frame, and a cut sheet handling system including a sheet path, a stalled sheet folding and flattening apparatus for reducing a sheet stalled between a withdrawable and a fixed component of the sheet handling system into a shape and size suitably enabling reliable removal of the stalled sheet through a relatively narrow gap between the withdrawable and fixed components of the sheet handling system, the stalled sheet folding and flattening apparatus comprising:

(a) a fixed component of the sheet handling system connected to the machine frame and having a first section of the sheet path;

(b) a withdrawable component of the sheet handling system mounted to the frame and having a sheet flattening side defining a relatively narrow gap between a fixed surface within the machine and said withdrawable component, said withdrawable component including a nip for gripping a trail end of a sheet stalled between the withdrawable component and the fixed component, and a second section of the sheet path, said second section adjoining said first section of the sheet path; and (c) a sheet folding device mounted to said fixed component and including a generally U-shaped portion having a sheet contact compound surface for contacting and deflecting an edge of a sheet, stalled between the withdrawable component and the fixed component, into a first fold having a first fold line, when said withdrawable component while gripping the trail end of the stalled sheet is being pulled out of the machine, said sheet contact compound surface (i) defining a slot forming a part of said first section of the sheet path, and (ii) having a first radius of curvature defining a concave first surface for deflecting and folding an edge of the stalled sheet to form a first fold line, and a second radius of curvature defining a convex second surface for guiding the deflected and folded sheet out of said slot.

2. The stalled sheet folding and flattening apparatus of claim 1, wherein said second section of the sheet path includes a sheet gripping nip for retaining a trail end of a stalled sheet being deflected, folded to form fold lines and pulled out of said slot by said withdrawable component.

3. The stalled sheet folding and flattening apparatus of claim 2, wherein, for causing a first fold line in an edge of a portion of a stalled sheet extending from said sheet gripping nip, and for causing a remainder of the extending sheet portion to buckle into at least a second fold line, said first radius of said U-shaped portion is less than one half of an edge to edge dimension of the stalled sheet, wherein the stalled sheet ordinarily is being moved lead end followed by trail end, through the sheet path.

4. The stalled sheet folding and flattening apparatus of claim 2, wherein, for causing the first fold line, and the remainder of the extending sheet portion to buckle into two additional folds having fold lines, said first radius of said U-shaped portion is less than one third the edge to edge dimension of a stalled sheet, wherein the stalled sheet ordinarily is being moved lead end followed by trail end, through the sheet path.

5. The stalled sheet folding and flattening apparatus of claim 4, wherein said sheet folding device is mounted at the interface between said fixed component and said withdrawable component for cooperating with said sheet flattening side of said withdrawable component to deflect, buckle fold into fold line and flatten the extending portion of the stalled sheet, through said narrow gap between said withdrawable and said fixed components, as said withdrawable component is being pulled out of the machine, thus reducing said extending portion of the sheet into a shape and size suitably enabling reliable removal through said narrow gap.

6. The stalled sheet folding and flattening apparatus of claim 1, wherein said fixed component comprises a fixed portion of the machine frame having an opening therethrough forming a part of the sheet path.

7. The stalled sheet folding and flattening apparatus of claim 1, wherein said concave first surface and said convex second surface intersect along a common sheet contact line.

8. In an electrostatographic reproduction machine having a frame and a cut sheet handling system including a fixed component and a withdrawable component, a stalled sheet folding device mounted to the fixed component, said withdrawable component including an nip for gripping a trail end of a sheet stalled between the withdrawable component and the fixed component, the stalled sheet folding device comprising a generally U-shaped member, said generally U-shaped member including first and second arm portions, and a base portion defining a slot, said base portion having a sheet contact compound inside surface forming a part of an edge of a first section of a sheet path through the fixed component, said contact compound inside surface of said U-shaped portion having a first radius of curvature defining a first concave inside surface for deflecting and creating a first fold line in the stalled sheet, and a second radius of curvature defining a second convex inside surface for guiding and creating additional folds having fold lines in the stalled sheet when the withdrawable component while gripping the trail end of the stalled sheet is being pulled out of the machine relative to the fixed component.

9. The stalled sheet folding device of claim 8, wherein each of said first and second arm portions of said U-shaped member includes a radius of curvature defining a convex inside surface for guiding a sheet being handled across the interface between the withdrawable and the fixed components of the sheet handling system.

* * * * *